US007819635B2

(12) United States Patent
Huntley et al.

(10) Patent No.: US 7,819,635 B2
(45) Date of Patent: Oct. 26, 2010

(54) VACUUM PUMP WITH A CONTINUOUS IGNITION SOURCE

(75) Inventors: Graeme Huntley, Bridgwater (GB); Andrew James Seeley, Bristol (GB); James Robert Smith, Taunton (GB)

(73) Assignee: Edwards Limited, Crawley, West Sussex (GB)

( * ) Notice: Subject to any disclaimer, the term of this patent is extended or adjusted under 35 U.S.C. 154(b) by 728 days.

(21) Appl. No.: 10/594,402

(22) PCT Filed: Mar. 8, 2005

(86) PCT No.: PCT/GB2005/000881

§ 371 (c)(1),
(2), (4) Date: Jun. 8, 2007

(87) PCT Pub. No.: WO2005/093260

PCT Pub. Date: Oct. 6, 2005

(65) Prior Publication Data

US 2007/0231162 A1 Oct. 4, 2007

(30) Foreign Application Priority Data

Mar. 26, 2004 (GB) ..... 0406748.4

(51) Int. Cl.
*F04B 3/00* (2006.01)

(52) U.S. Cl. ..... 417/244; 417/423.4; 417/572; 431/346

(58) Field of Classification Search ..... 417/53, 417/423.4, 572, 244; 423/210; 415/90; 431/2, 431/346

See application file for complete search history.

(56) References Cited

U.S. PATENT DOCUMENTS

| | | | | |
|---|---|---|---|---|
| 2,993,639 | A * | 7/1961 | Foster | 417/171 |
| 4,007,715 | A * | 2/1977 | Bonnell et al. | 123/239 |
| 4,555,389 | A * | 11/1985 | Soneta et al. | 423/210 |
| 4,801,437 | A | 1/1989 | Konagaya et al. | |
| 4,886,444 | A | 12/1989 | Hirase et al. | |
| 5,183,646 | A * | 2/1993 | Anderson et al. | 423/210 |
| 5,301,510 | A | 4/1994 | Glasser | |
| 5,458,862 | A * | 10/1995 | Glawion | 423/245.3 |
| 5,639,208 | A * | 6/1997 | Theis | 415/60 |
| 5,879,139 | A * | 3/1999 | Hayashi et al. | 417/292 |
| 5,955,037 | A * | 9/1999 | Holst et al. | 422/171 |
| 6,183,641 | B1 * | 2/2001 | Conrad et al. | 210/512.3 |
| 6,253,029 | B1 * | 6/2001 | Hayashi et al. | 392/471 |
| 6,361,706 | B1 * | 3/2002 | Gabriel | 216/67 |
| 6,779,964 | B2 * | 8/2004 | Dial | 415/1 |

(Continued)

FOREIGN PATENT DOCUMENTS

EP 0 332 107 B1 7/1992

(Continued)

OTHER PUBLICATIONS

Umeda Yukio, Ishii Haruo, Iketani Mikio, Soneda Sakanobu; abstract of JP 59082927 A, "Treatment of Waste Gas," May 14, 1984; Toyo Sanso KK.

(Continued)

*Primary Examiner*—Devon C Kramer
*Assistant Examiner*—Nathan Zollinger

(57) ABSTRACT

A multi-stage vacuum pump comprises, between adjacent stages of the pump, a continuous ignition source for igniting a fuel within a pumped fluid. This can ensure that the concentration of the fuel in fluid exhaust from the pump is below its lower explosive limit.

26 Claims, 3 Drawing Sheets

U.S. PATENT DOCUMENTS

| | | | | |
|---|---|---|---|---|
| 6,874,989 | B2 * | 4/2005 | Kuramoto et al. | 415/119 |
| 7,569,193 | B2 * | 8/2009 | Ferron et al. | 422/168 |
| 2003/0000823 | A1 | 1/2003 | Uhm et al. | |
| 2004/0112308 | A1 * | 6/2004 | Jones | 123/46 R |
| 2005/0147509 | A1 * | 7/2005 | Bailey et al. | 417/423.4 |
| 2007/0183909 | A1 * | 8/2007 | Kusay et al. | 417/422 |
| 2010/0086883 | A1 * | 4/2010 | Zollig et al. | 431/12 |

FOREIGN PATENT DOCUMENTS

EP 1 039 187 B1 4/2005

OTHER PUBLICATIONS

Sakai Takamasa, Muraoka Yusuke, Terajima Kozo, Nakatani Ikuyoshi; abstract of JP 63195388 A, "Vacuum Exhaust," Aug. 12, 1988; DaiNippon Screen Mfg Co Ltd.

United Kingdom Search Report of Application No. GB 0406748.4; Date of mailing: Jul. 20, 2004; claims searched: 1-16; Date of search: Jul. 19, 2004.

PCT Notification of Transmittal of the International Search Report and the Written Opinion of the International Searching Authority, or the Declaration of International Application No. PCT/GB2005/000881; Date of mailing: Jun. 22, 2005.

PCT International Search Report of International Application No. PCT/GB2005/000881; Date of mailing of the International Search Report: Jun. 22, 2005.

PCT Written Opinion of the International Searching Authority of International Application No. PCT/GB2005/000881; Date of mailing: Jun. 22, 2005.

* cited by examiner

VACUUM PUMP WITH A CONTINUOUS IGNITION SOURCE

FIELD OF THE INVENTION

The present invention relates to a vacuum pump.

BACKGROUND OF THE INVENTION

Vacuum pumping arrangements used to pump fluid from semiconductor tools typically employ, as a backing pump, a multi-stage positive displacement pump employing intermeshing rotors. The rotors may have the same type of profile in each stage or the profile may change from stage to stage.

Many semiconductor processes use or generate potentially flammable mixtures containing fuels such as hydrogen and silane. The pumping of such mixtures requires great care to be placed on the leak integrity of the foreline and exhaust lines from the pump to ensure that there is no ingress of air into the lines which could create a flammable atmosphere. Moreover, in some processes a fuel and an oxidant, for example TEOS (tetraethoxysilane) and ozone, may flow through the pump at the same time. In such circumstances any hot spots within the pump could provide intermittent ignition sources for the fuel, which could result in the generation of hazardous flame fronts travelling through the pump into the exhaust lines.

It is an aim of at least the preferred embodiments of the present invention to seek to solve these and other problems.

SUMMARY OF THE INVENTION

In one aspect, the present invention provides a vacuum pump comprising a continuous ignition source for igniting fuel within a pumped fluid to regulate the concentration of the fuel in fluid exhaust from the pump.

In the preferred embodiments, the pump is in the form of a multi-stage vacuum pump, with the continuous ignition source being located between adjacent stages of the pump. Thus, in a second aspect the present invention provides a multi-stage vacuum pump comprising, between adjacent stages of the pump, a continuous ignition source for igniting a fuel within a pumped fluid.

In a further aspect, the present invention provides a method of treating a fluid containing a fuel, the method comprising conveying the fluid to a vacuum pump and, within the pump, igniting the fuel to regulate the concentration of the fuel in fluid exhaust from the pump.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
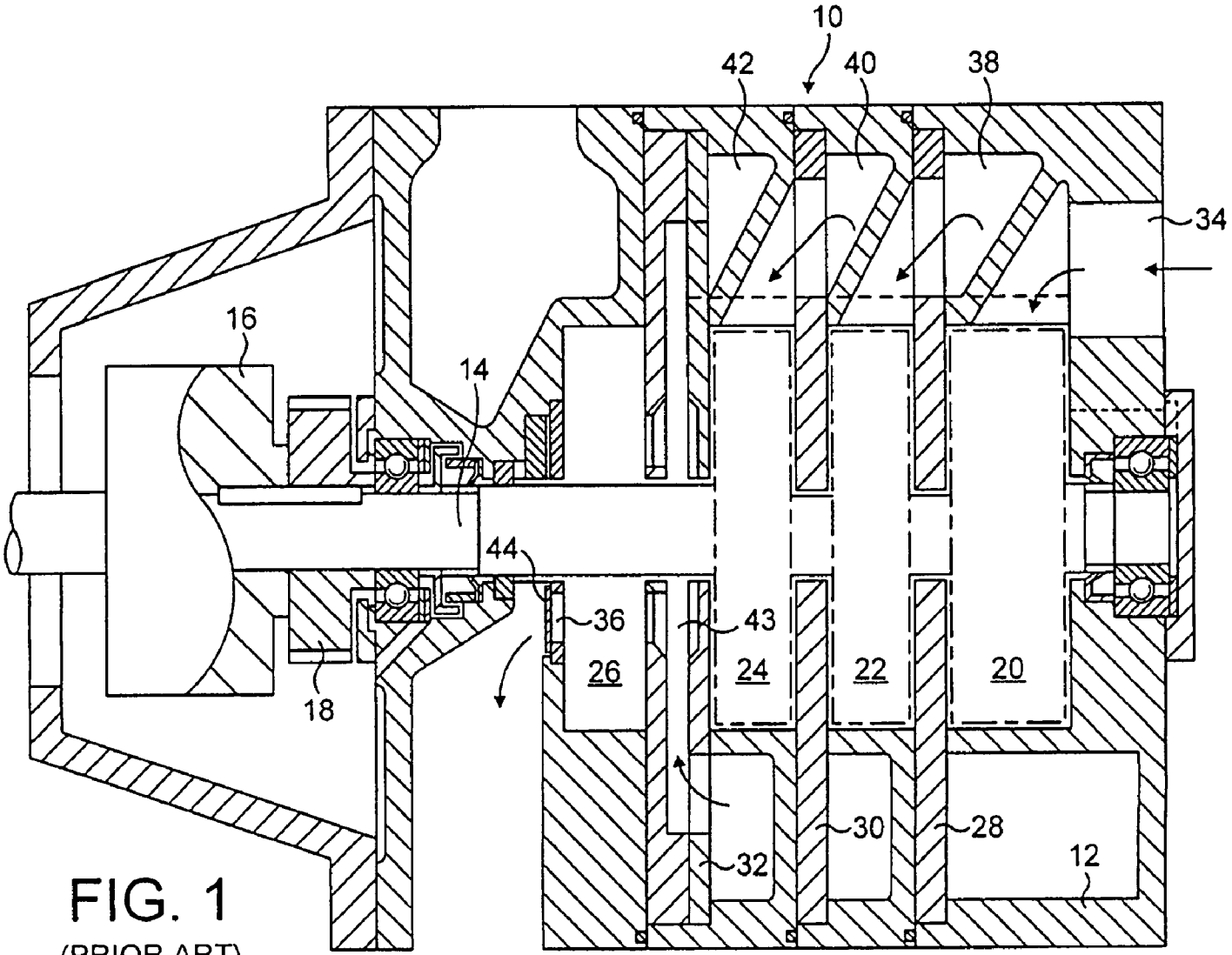
FIG. 1 (PRIOR ART)
FIG. 1 is a cross-section of a known multi-stage pump.

By introducing a continuous ignition source into the pump, a reaction between any fuel/oxidant mixtures within the pumped fluid, which, within the pump, will be at a relatively low fluid pressure, can be deliberately initiated. By deliberately initiating the reaction at a controlled location, it can be ensured that the pressure rise generated by such reactions (usually around ten times the start pressure) will be less than atmospheric pressure, so that the reactions can be confined within the pump and thereby pose little or no hazard.

Regulating the concentration of fuel in the fluid exhaust from the pump to below its lower explosion limit (LEL) can minimise the likelihood of a flammable atmosphere being created downstream from the pump outlet by, for example, a leak in the exhaust line from the pump. To achieve this, the reactions initiated within the pump need not be complete prior to the exhaust of the fuel from the pump. Furthermore, deliberately reacting the fluid to maintain the fuel concentration below its LEL can minimise the amount of purge fluid, such as nitrogen, which would otherwise be required to reduce the fuel concentration below its LEL, thereby saving costs.

The continuous ignition source may be provided in any convenient form, for example, by an electric discharge device, spark plug, heated filament, glow discharge or other plasma source.

The pump preferably comprises a plurality of continuous ignition sources each located between respective adjacent stages of the pump. By introducing into the pump continuous ignition sources at respective locations between which the fluid pressure varies from, say, 50 mbar to 950 mbar, any fuel/oxidant mixtures within the pumped fluid will react over a range of pressures existing within the pump. Spreading the reaction over a range of pressures can ensure that the pressure rise generated within the pump by fuel ignition will be less than atmospheric pressure.

In view of the reactions deliberately initiated within the pump, it may be necessary to increase the amount of coolant supplied to the pump. In one preferred embodiment the continuous ignition source is provided within a combustion chamber located between stages of the pump. Confining at least part of the reaction to within a combustion chamber can facilitate the provision of additional cooling to the pump.

The pump may be provided with means for injecting into the pump a fluid stream comprising an oxidant, for example, air, clean dry air (CDA) or oxygen, for assisting in igniting the fuel. This fluid stream may also, or alternatively, comprise a fuel for increasing the likelihood of ignition occurring within the pump. Deliberate introduction of an oxidant and/or fuel into the pump can increase the likelihood of fuel combustion within the pump. This fluid stream can be conveniently injected into the pump between adjacent stages of the pump, for example, through a port provided for the injection into the pump of a purge gas such as nitrogen. Where a combustion chamber is provided within the pump, the fluid stream is preferably injected directly into this chamber.

FIG. 1 illustrates an example of a known multi-stage pump 10. The pump 10 comprises a pumping chamber 12 through which pass a pair of parallel shafts 14 (only one shown). One shaft 14 is drivable via a motor 16. Adjacent the motor 16 each shaft 14 carries a timing gear 18.

Each shaft 14 supports for rotation therewith a plurality of rotors. In this example, each shaft carries, or has integral therewith, four rotors 20, 22, 24 and 26, although the pump may carry any number of rotors. The rotors are "claw") profile or screw profile. The rotors may have the same type of profile in each stage or the profile may change from stage to stage. For example, rotors having a screw profile may vary in pitch from stage to stage.

The pumping chamber 12 is divided by partitions 28, 30 and 32 into four spaced locations each occupied by a pair of rotors. An inlet 34 of the pumping chamber 12 communicates directly with the location occupied by the rotors 20, and an outlet 36 of the pumping chamber 12 communicates directly with the location occupied by rotors 26. Fluid passageways 38, 40, 42 and 43 are provided to permit the passage therethrough of pumped fluid from the inlet 34 to the outlet 36, the flow of pumped fluid from the outlet being controlled by one-way valve 44.

In use, when the motor drives one shaft 14, by means of the timing gears 18 both shafts 14 will be driven in synchronisation thereby driving the various pairs of profiled rotors 20 to 26 synchronously. Fluid to be pumped will enter the inlet 34 and will be pumped successively through passageways 38, 40, 42, 43 until it exits via the outlet 36 as indicated by the arrows. The pump can attain a high vacuum (for example, around or below 0.01 mbar) without the use of lubricants within the pumping chamber. It can maintain a high pumping capacity at low pressures and can compress the pumped fluid to at least atmospheric pressure.

Figure 2:
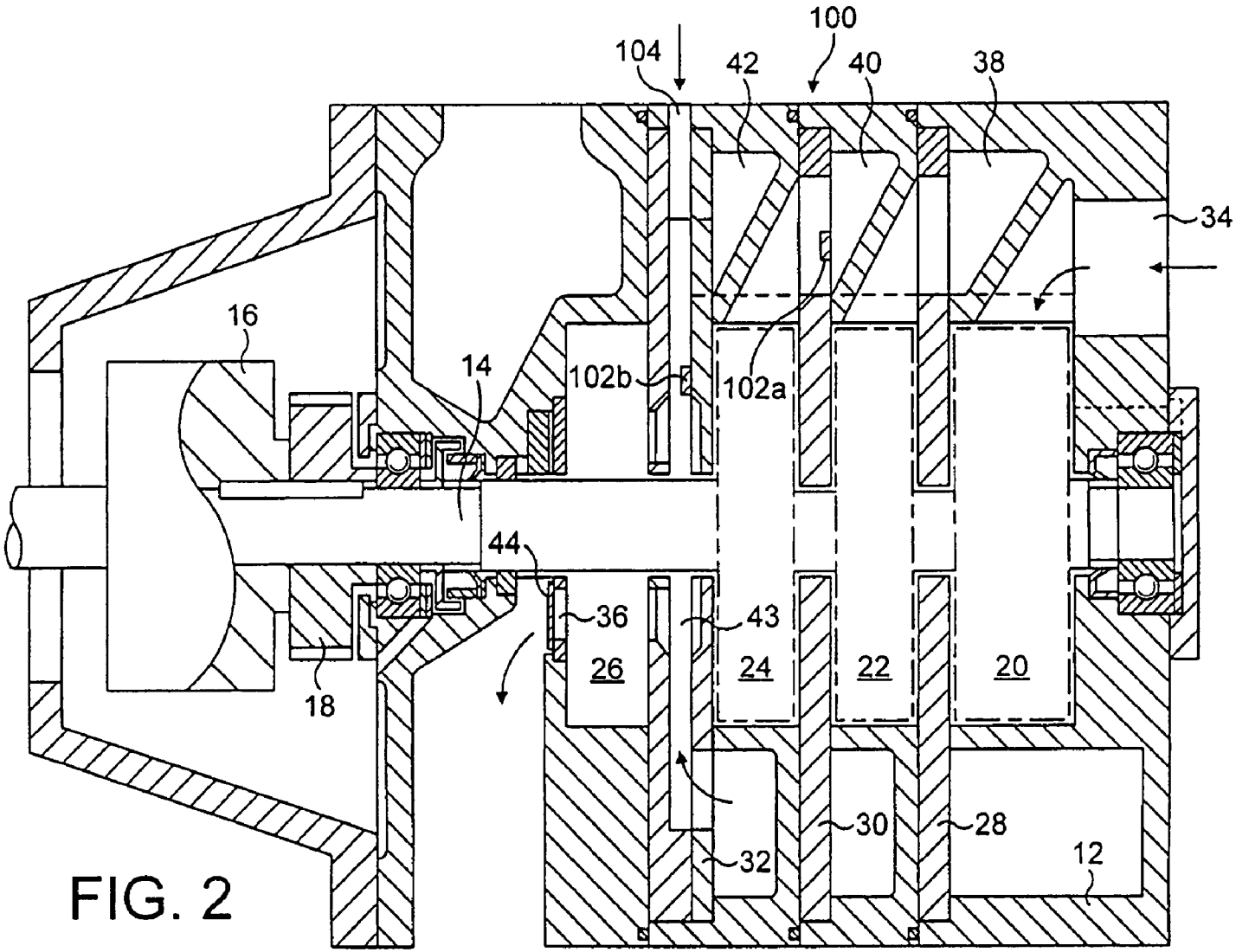
FIG. 2 is a cross-section of a first embodiment of a multi-stage pump.

FIG. 2 illustrates a first embodiment of a multi-stage pump 100 according to the present invention. In FIG. 2, for simplicity the pump 100 is represented as a modification of the pump shown in FIG. 1, although of course the pump 100 could vary from the pump 10 in relation to, for example, the number and size of the rotors, the locations of the inlet, outlet and fluid passages therebetween, the location and nature of the coupling 16, and so on. As illustrated, the pump 100 varies from the known pump 10 in that the pump 100 includes at least one continuous ignition source for fuel contained in the pumped fluid. By providing deliberate, continuous ignition of the fuel within the pump 100, the concentration of fuel within the fluid exhaust from the pump 100 can be maintained below its lower explosive limit (LEL).

In the embodiment illustrated, the pump 100 includes two ignition sources 102*a*, 102*b* each located between adjacent stages of the pump 100, that is, ignition source 102*a* being located between rotors 22 and 24, and ignition source 102*b* being located between rotors 24 and 26. Alternatively, the pump 100 may comprise an ignition source between each adjacent stage. Two or more ignitions sources may be provided between each pumping stage as appropriate. By introducing into the pump continuous ignition sources at respective locations between which the fluid pressure varies from, say, 50 mbar to 950 mbar, any fuel/oxidant mixtures within the pumped fluid will react over a range of pressures existing within the pump. Spreading the reaction over a range of pressures can ensure that the pressure rise generated within the pump by fuel ignition will be less than atmospheric pressure so as to confine fluid combustion to within the pump 100.

Each ignition source may be provided in any convenient form, for example, by an electric discharge device, spark plug, heated filament, glow discharge or other plasma source.

In order to assist in the combustion of fuel within the pumped fluid, an oxidant such as CDA or oxygen can be injected into the pump 100 through a purge port 104. This can be advantageous where the pumped fluid contains an insufficient amount of oxidant for combustion to be initiated within the pump. In order to increase the likelihood of combustion taking place within the pump, this injected fluid may optionally comprise a fuel, or a mixture of fuel and oxidant.

Figure 3:
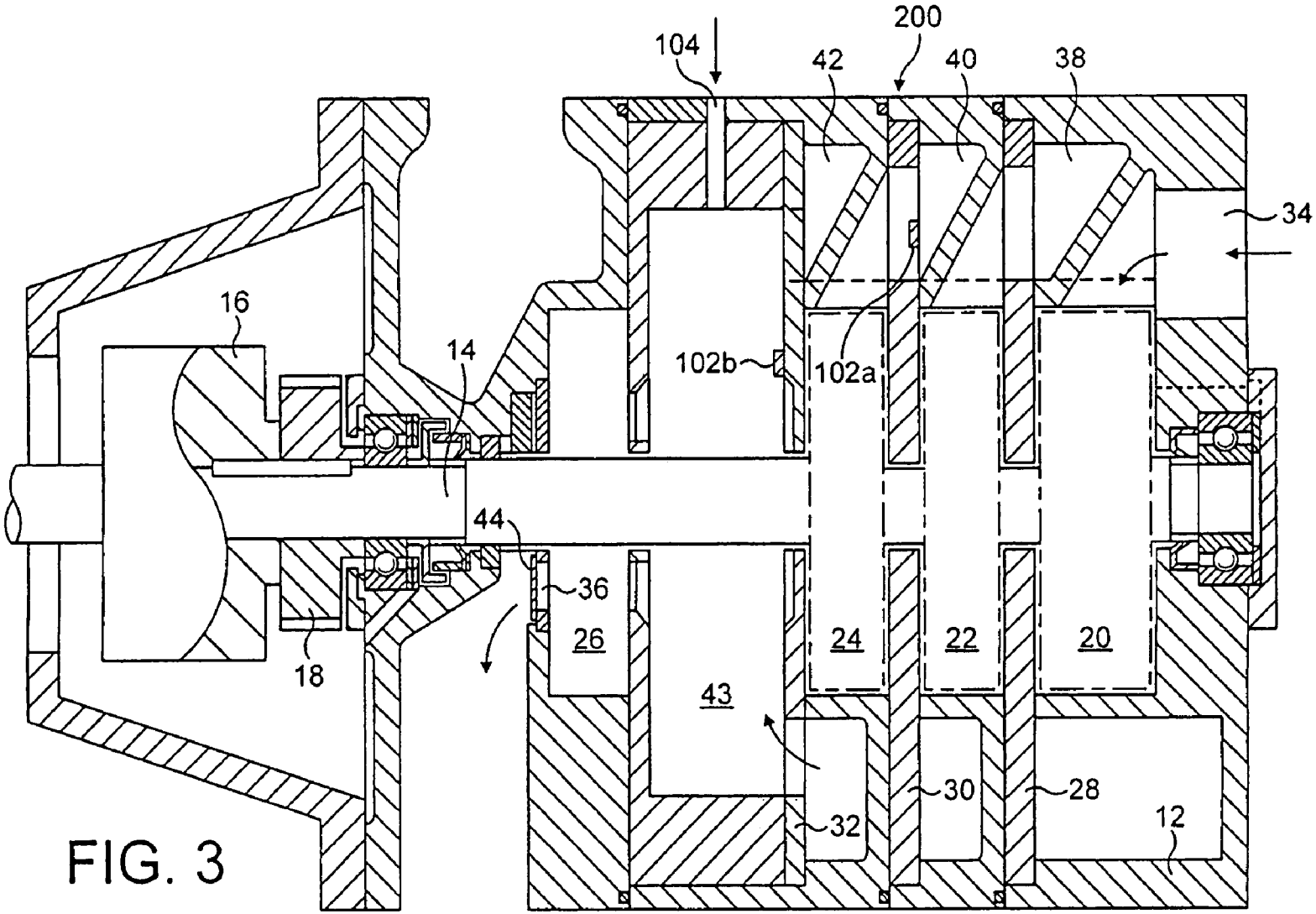
FIG. 3 is a cross-section of a second embodiment of a multi-stage pump.

In view of the reactions deliberately initiated within the pump, it may be necessary to increase the amount of coolant supplied to the pump. In the embodiment shown in FIG. 3, the size of the fluid passageway 43 has been increased to define a combustion chamber between pumping stages of the pump 200. This can facilitate the provision of additional cooling to the pump.

The invention has been described above in relation to a multi-stage dry pump, but one or more continuous ignition sources may also be used in a single stage pump, for example, a screw pump with a continuous ignition source located within a wrap or a volume created in the stator.

While the foregoing description and drawings represent the preferred embodiments of the present invention, it will be apparent to those skilled in the art that various changes and modifications may be made therein without departing from the true spirit and scope of the present invention.

We claim:

1. A vacuum pump comprising:

a stator;

a rotor adapted to rotate relative to the stator for pumping fluid from an inlet to an outlet; and a continuous ignition source for igniting fuel within a pumped fluid in the stator to regulate the concentration of the fuel in fluid exhaust from the pump, wherein the pressure of pumped fluid at the ignition source is in the range from 50 to 950 mbar; and a means for injecting into the pump a fluid stream comprising an oxidant for assisting in igniting the fuel.

2. The pump according to claim 1 wherein the continuous ignition source is an electric discharge device.

3. The pump according to claim 1 wherein the continuous ignition source is a spark plug.

4. The pump according to claim 1 wherein the continuous ignition source is a heated filament.

5. The pump according to claim 1 wherein the continuous ignition source is a plasma.

6. The pump according to claim 1 comprising a multi-stage vacuum pump and the continuous ignition source is located between adjacent stages of the pump.

7. A multi-stage vacuum pump comprising:

a plurality of stages of pumps, each of which includes a stator and a rotor adapted to rotate relative to the stator for pumping fluid through the stages of pumps; and a continuous ignition source between adjacent stages of the pumps for igniting a fuel within a pumped fluid in the stator, wherein the pressure of pumped fluid at the ignition source is in the range from 50 to 950 mbar; and a means for injecting into the pump a fluid stream comprising an oxidant for assisting in igniting the fuel.

8. The pump according to claim 7 wherein the continuous ignition source is located within a combustion chamber.

9. The pump according to claim 7 comprising a plurality of continuous ignition sources each located between respective adjacent stages of the pump.

10. The pump according to claim 1 wherein the oxidant is one of oxygen and CDA.

11. The pump according to claim 1 wherein the injected fluid stream also comprises a fuel for increasing the likelihood of ignition occurring within the pump.

12. The pump according to claim 1 wherein the injection means is arranged to inject the fluid stream between adjacent stages of the pump.

13. The pump according to claim 7 wherein the fluid stream is injected into the combustion chamber.

14. A method of treating a fluid containing a fuel, the method comprising conveying the fluid to a vacuum pump and, within the pump, igniting the fuel to regulate the concentration of the fuel in fluid exhaust from the pump, and injecting a fluid stream comprising an oxidant for assisting in igniting the fuel, wherein the pressure of the ignited fuel in the vacuum pump is in the range from 50 to 950 mbar.

15. The pump according to claim 6 wherein the continuous ignition source is located within a combustion chamber.

16. The pump according to claim 6 comprising a plurality of continuous ignition sources each located between respective adjacent stages of the pump.

17. The pump according to claim 8 comprising a plurality of continuous ignition sources each located between respective adjacent stages of the pump.

18. The pump according to claim 1 comprising means for injecting into the pump a fluid stream comprising an oxidant for assisting in igniting the fuel.

19. The pump according to claim 10 wherein the injected fluid stream also comprises a fuel for increasing the likelihood of ignition occurring within the pump.

20. The pump according to claim 10 wherein the means for injecting is arranged to inject the fluid stream between adjacent stages of the pump.

21. The pump according to claim 11 wherein the means for injecting is arranged to inject the fluid stream between adjacent stages of the pump.

22. The pump according to claim 8 wherein the oxidant is one of oxygen and CDA.

23. The pump according to claim 8 wherein the fluid stream is injected into the combustion chamber.

24. The pump according to claim 22 wherein the fluid stream is injected into the combustion chamber.

25. The pump according to claim 22 wherein the injected fluid stream also comprises a fuel for increasing the likelihood of ignition occurring within the pump.

26. The pump according to claim 25 wherein the means for injecting is arranged to inject the fluid stream between adjacent stages of the pump.

* * * * *